US006932756B2

(12) United States Patent
Franchi

(10) Patent No.: US 6,932,756 B2
(45) Date of Patent: Aug. 23, 2005

(54) CORRUGATED CARDBOARD MANUFACTURING MACHINE

(75) Inventor: Paolo Franchi, Brescia (IT)

(73) Assignee: Feltri Marone S.p.A., Marone (IT)

( * ) Notice: Subject to any disclaimer, the term of this patent is extended or adjusted under 35 U.S.C. 154(b) by 0 days.

(21) Appl. No.: 10/312,498

(22) PCT Filed: Dec. 28, 2000

(86) PCT No.: PCT/IT00/00551

§ 371 (c)(1),
(2), (4) Date: May 2, 2003

(87) PCT Pub. No.: WO02/02307

PCT Pub. Date: Jan. 10, 2002

(65) Prior Publication Data

US 2003/0166444 A1 Sep. 4, 2003

(30) Foreign Application Priority Data

Jun. 30, 2000 (IT) ..... MI2000A1483

(51) Int. Cl.[7] ..... B31F 1/20

(52) U.S. Cl. ..... 493/463; 156/462; 156/470; 428/222; 428/316.6; 34/660; 34/236

(58) Field of Search ..... 493/463; 156/462, 156/470; 428/222, 316.6; 34/660, 236; 162/358.2, 900, 902

(56) References Cited

U.S. PATENT DOCUMENTS

| | | | | | |
|---|---|---|---|---|---|
| 3,368,933 | A | * | 2/1968 | Wicker | 156/498 |
| 4,345,730 | A | | 8/1982 | Leuvelink | |
| 4,395,308 | A | * | 7/1983 | Dawes | 162/232 |
| 4,481,079 | A | * | 11/1984 | Dawes | 162/348 |
| 4,535,824 | A | | 8/1985 | Kerber et al. | |
| 4,675,229 | A | | 6/1987 | Westhead | |
| 4,839,213 | A | * | 6/1989 | Gauthier | 428/114 |
| 4,857,391 | A | * | 8/1989 | Westhead | 428/222 |
| 5,104,724 | A | * | 4/1992 | Hsu | 428/222 |
| 5,115,582 | A | * | 5/1992 | Westhead | 34/123 |
| 5,217,577 | A | * | 6/1993 | Steiner | 162/232 |
| 5,364,692 | A | * | 11/1994 | Bowen et al. | 428/222 |
| 6,186,209 | B1 | * | 2/2001 | Lanthier | 156/470 |
| 6,276,420 | B1 | * | 8/2001 | Lanthier | 156/462 |
| 6,470,944 | B1 | * | 10/2002 | Billings et al. | 156/462 |
| 6,627,045 | B2 | * | 9/2003 | Raczkowski et al. | 162/348 |

FOREIGN PATENT DOCUMENTS

| | | |
|---|---|---|
| CH | 610 273 A | 4/1979 |
| DE | 24 19 751 | 12/1975 |
| EP | 0 950 508 A | 10/1999 |

* cited by examiner

*Primary Examiner*—Louis K. Huynh
*Assistant Examiner*—Hemant M. Desai
(74) *Attorney, Agent, or Firm*—Frost Brown Todd LLC

(57) ABSTRACT

A corrugated cardboard manufacturing machine (10) wherein at least one continuous supporting belt (11) for supporting/conveying a sheet of cardboard is moved along a predetermined path by actuating means (13); and where the supporting belt (11) is defined by a mat of multispiral fabric (1) preferably made of synthetic polymer fibers.

4 Claims, 1 Drawing Sheet

CORRUGATED CARDBOARD MANUFACTURING MACHINE

This application is a 371 of PCT/ IT 00/0051 filed on Dec. 28, 2000.

TECHNICAL FIELD

The present invention relates to a corrugated cardboard manufacturing machine featuring a new type of cardboard supporting/conveying belt, which has never been used before for this purpose and has proved surprisingly advantageous as compared with traditionally used belts.

BACKGROUND ART

As is known, corrugated cardboard, of the type normally used for boxes or miscellaneous packaging, is produced on special corrugating machines: the sheets of cardboard are fed to the corrugating machine packed tightly between respective cylinder-operated supporting/conveying belts, and are subjected to the combined action of heating assemblies and pressure plates for gluing and shaping the various layers forming the corrugated cardboard.

On known machines, the belts supporting and conveying the cardboard sheets are made of felt, in particular acicular felt, or conventional fabric, which involves various drawbacks. Firstly, felt or conventional fabrics, mainly on account of not always being of even thickness, fail to provide for thin, top-quality finished products, and are therefore unsuitable for producing boxes or packages for select items such as perfume, ornaments, etc., unless the output speed of the machine is greatly reduced. Moreover, felt or conventional fabrics, which must be joined when fitted to the corrugating machine, show marked breaks in continuity at the joints, which further impair the quality of the finished product.

Felt or conventional fabrics are also relatively heavy and therefore difficult to assemble onto the machine; the weight, combined with a high friction coefficient, of such materials increases the energy consumption of the machine; and, finally, not being very permeable, felt or conventional fabrics not only impair dispersion of the steam issuing from the cardboard, but also call for coating the cardboard with a relatively large amount of glue.

DISCLOSURE OF INVENTION

It is an object of the present invention to eliminate the aforementioned drawbacks of known corrugated cardboard manufacturing machines. In particular, it is an object of the invention to provide a new type of cardboard sheet supporting/conveying belt, which can be used on conventional corrugating machines, and which has none of the aforementioned drawbacks of traditionally used belts.

According to the present invention, there is provided a corrugated cardboard manufacturing machine of the type comprising at least one continuous supporting belt for supporting and conveying a respective sheet of cardboard; and actuating means for moving said at least one supporting belt along a predetermined path; the machine being characterized in that said at least one supporting belt is defined by a mat made of multispiral fabric in direct contact with said respective sheet of cardboard.

Generally speaking, the present invention therefore relates to the use of a mat of multispiral fabric as a belt for supporting and/or conveying a sheet of cardboard on a corrugated cardboard manufacturing machine.

Here and hereinafter, the term "multispiral fabric" is intended to mean a commonly known fabric normally (though not necessarily) made of synthetic polymer fibers, and defined by a number of spirally wound helical bands arranged side by side longitudinally with the relative turns penetrating one another. The helical bands may be connected to one another by connecting yarns inserted through the adjacent turns of the bands, or by directly connecting the turns, which, for the purpose, are provided with connecting nodes. Both solutions are illustrated in detail, for example, in Swiss Patent n. 610273. Further examples of this type of fabric are illustrated in detail in numerous patent publications, including German Patent n. 2419751 and U.S. Pat. Nos. 4,535,824 and 4,345,730, the content of which is included herein purely by way of reference as required for a clear understanding of the present invention.

Up until now, multispiral fabrics of the type referred to have been used as such on paper manufacturing machines; which application obviously calls for characteristics differing widely from those of corrugating machines, on which the supporting belt, as opposed to receiving mixture which is gradually converted into a sheet of paper, supports cardboard sheets to be shaped and connected appropriately to form corrugated cardboard.

On otherwise known corrugated cardboard manufacturing machines, using multispiral fabrics in place of at least one of the felt or conventional fabric belts (the top belt) has been found to have totally unexpected technical effects affording considerable advantages as regards the corrugated cardboard manufacturing process.

Firstly, using belts made of multispiral fabrics in direct contact with the cardboard, in accordance with the present invention, permits a surprising and unpredictable reduction in the energy consumption of the machine. Though multispiral fabrics are much lighter than felt or conventional fabrics, comparative tests have surprisingly shown the energy saving derived by substituting multispiral fabric belts for conventional belts to be greater than what might be expected and calculated solely on the basis of the difference in weight of the materials used. Particularly in contact with the cardboard sheets, the friction coefficient values of multispiral fabrics have surprisingly proved much lower than those of felt or conventional fabrics, while at the same time being sufficient to ensure correct conveyance of the cardboard in direct contact with the multispiral fabric, with or without the aid of a second felt of conventional fabric belt.

The lighter weight of multispiral fabrics as compared with felt or conventional fabrics also makes for easier handling and for easier, faster assembly to the corrugating machine.

Multispiral fabrics have also been found to be much more permeable than felt or conventional fabrics, thus enabling fast, effective dispersion of the steam issuing from the cardboard during processing. Effective evaporation also enables a smaller amount of glue to be applied to the cardboard.

The even thickness of multispiral fabric mats also enables accurate pressure transmission to the cardboard by the pressure plates on the corrugating machine, thus ensuring perfect gluing, even at high production speeds and using thin ("microcorrugated") cardboard. Even at high machine operating speeds, it is therefore possible to obtain top-quality finished products, even of small thickness, perfectly suitable for boxes or packages for select items (in particular, perfume, ornaments, etc.). Multispiral fabrics have been found to produce corrugated cardboard of any type, with no restrictions as to composition or weight, while at the same time permitting relatively high production speeds and excellent finished product quality.

In addition to the nature of the yarns (preferably polymer) from which it is made, the surface structure of the multispiral mat is such as to permit fast, easy cleaning with no danger of damaging the surface.

The multispiral mat is also of considerable dimensional stability, which eliminates any risk of excessive in-service stretching or shrinking of the supporting belt which might impair operation of the corrugating machine and the quality of the finished cardboard.

Finally, the multispiral mat is perfectly homogeneous with no variations in thickness or physical-mechanical characteristics at the joints, which are even with the rest of the surface of the mat, thus preventing any marked impressions or unevenness in the finished cardboard.

Table 1 below shows the most significant results of comparative tests conducted on conventional corrugated cardboard manufacturing machines using supporting belts made of felt or conventional fabrics and belts of multispiral fabrics according to the invention.

The data shown in Table 1 confirms the advantages already mentioned with respect to felt or conventional fabrics. In particular, using multispiral mats according to the invention, which are much thinner, lighter and permeable than felt or conventional fabrics, provides for a significant reduction in the energy consumption of the corrugating machine and in the amount of glue used.

TABLE 1

| | Conventional felt or fabric | Multispiral mat |
|---|---|---|
| Weight [g/m$^2$] | 2600 ÷ 6800 | 1300 ÷ 1800 |
| CFM permeability | 5 ÷ 25 | 300 ÷ 1200 |
| Thickness [mm] | 7 ÷ 11 | 2.2 ÷ 4.0 |
| Cardboard layer glue [g/m$^2$] | 7 ÷ 8 | up to 30% less |
| Energy consumption of corrugating machine [A] | 220 ÷ 320 | <200 |

BRIEF DESCRIPTION OF THE DRAWINGS

A non-limiting embodiment of the present invention will be described by way of example with reference to the accompanying drawings, in which.

BEST MODE FOR CARRYING OUT THE INVENTION

Figure 1:
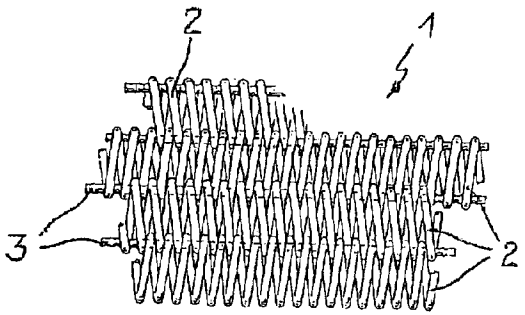
FIG. 1 shows, schematically, the known structure of a multispiral fabric mat for use in accordance with the invention.

FIG. 1 shows schematically a portion of a mat of multispiral fabric 1 of commonly known type and described, for example, in the aforementioned patents incorporated herein purely by way of reference. Generally speaking, the multispiral fabric, preferably made of synthetic polymer fibers, is defined by a number of spirally wound helical bands 2, which are arranged side by side longitudinally with the relative turns penetrating one another, and are connected to one another by connecting yarns 3 inserted through the adjacent turns of the bands.

Figure 2:
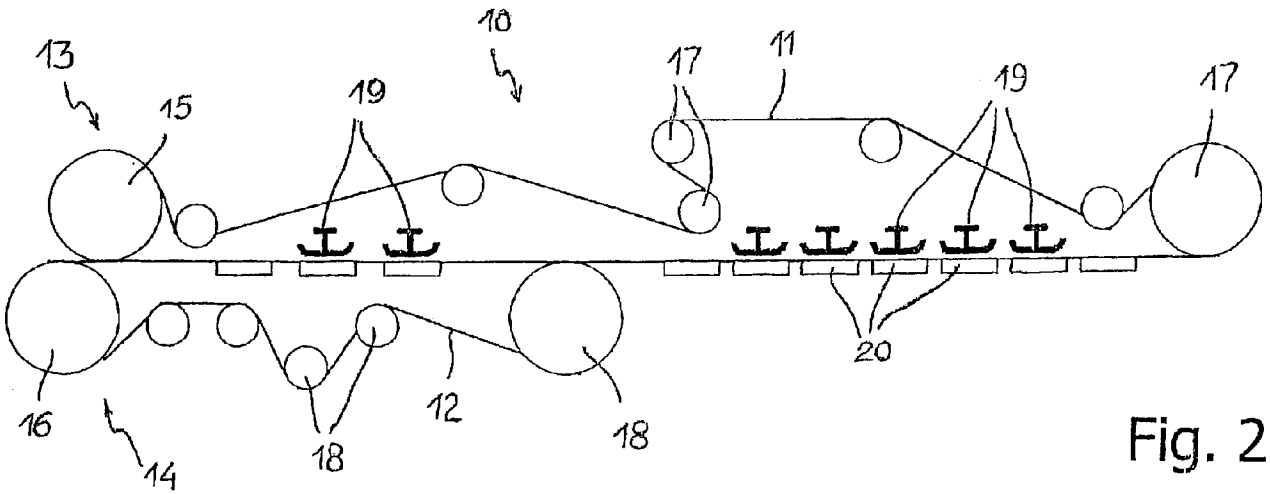
FIG. 2 shows a schematic longitudinal view of the overall structure of a corrugated cardboard manufacturing machine employing the FIG. 1 mat.

FIG. 2 shows schematically a known corrugated cardboard manufacturing machine 10, both the structure and operation of which are known and therefore not described in detail for the sake of simplicity. Briefly, being a machine with which an expert in this particular field is perfectly familiar, machine 10 substantially comprises a first continuous top supporting belt 11 and a second continuous bottom supporting belt 12 for supporting and conveying respective cardboard sheets (not shown); and actuating means 13, 14 for moving respective supporting belts 11, 12 along respective predetermined, at least partly superimposed paths. More specifically, actuating means 13 bring supporting belt 11 into direct contact with a top face of the relative cardboard sheet, and actuating means 14 bring supporting belt 12 into direct contact with a bottom face of the relative cardboard sheet. As is known, actuating means 13, 14 comprise respective powered draw cylinders 15, 16 and respective numbers of tensioning and/or transmission rollers 17, 18. Machine 10 also comprises a number of pressure plates 19, possibly arranged in separate groups, for exerting a predetermined pressure on the cardboard sheets; and heating means 20, e.g. heating surfaces, for heating the cardboard sheets.

According to the present invention, supporting belt 11 is defined by a mat of multispiral fabric of the type shown in FIG. 1 and appropriately cut and joined. As is known, joining adjacent portions of a multispiral fabric of this type produces no alteration in thickness and no unevenness of any sort. Supporting belt 12 may also be defined by a mat of multispiral fabric, possibly modified to improve adhesion to the cardboard.

What is claimed is:

1. A corrugated cardboard manufactuing machine (10) comprising at least one continuous supporting belt (11) for supporting and conveying a respective sheet of cardboard; and actuating means (13) for moving said at least one supporting belt (11) along a predetermined path; the machine being characterized in that said at least one supporting belt (11) is defined by a mat made of multispiral fabric (1), said multispiral fabric mat being defined by a number of connected spirally wound helical bands arranged side by side longitudinally with the relative turns penetrating one another, said machine being configured such that said multispiral fabric of said supporting belt is in direct contact with said respective sheet of cardboard.

2. A machine as claimed in claim 1, characterized by comprising a continuous first top supporting belt (11) and a continuous second bottom supporting belt (12) for supporting and conveying respective cardboard sheets packed tightly between said supporting belts (11, 12 ); and respective first and second actuating means (13, 14) for moving said supporting belts (11, 12) along respective predetermined, at least partly superimposed paths; said first top supporting belt (11) being defined by said mat of multispiral fabric (1) and being brought by said respective first actuating means (13) in direct contact with a top face of the relative sheet of cardboard.

3. A machine as claimed in claim 2, characterized in that said mat of multispiral fabric (1) is made of synthetic polymer fibers.

4. A machine as claimed in claim 1, characterized in that said mat of multispiral fabric (1) is made of synthetic polymer fibers.

* * * * *